US010357980B2

(12) United States Patent
Yoda

(10) Patent No.: US 10,357,980 B2
(45) Date of Patent: Jul. 23, 2019

(54) PRINTING APPARATUS AND ADJUSTMENT METHOD OF PRINTING APPARATUS

(71) Applicant: SEIKO EPSON CORPORATION, Tokyo (JP)

(72) Inventor: Tomohiro Yoda, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/025,133

(22) Filed: Jul. 2, 2018

(65) Prior Publication Data

US 2019/0001708 A1 Jan. 3, 2019

(30) Foreign Application Priority Data

Jul. 3, 2017 (JP) ..... 2017-130291

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 29/393; H04N 1/6033; H04N 1/6055; G01J 3/52; G01J 3/524; G01J 3/46; G01J 3/462; G01J 3/463; G01J 3/466; G01J 3/467; G06K 15/027
See application file for complete search history.

(56) References Cited

U.S. PATENT DOCUMENTS

2004/0184051 A1* 9/2004 Bailey ..... H04N 1/6033 358/1.9
2012/0069359 A1* 3/2012 Hirano ..... H04N 1/506 358/1.9
2012/0133961 A1* 5/2012 Henderson ..... G06K 15/027 358/1.9
2015/0158309 A1* 6/2015 Fujii ..... G01N 21/251 347/19

FOREIGN PATENT DOCUMENTS

WO WO-2017/033327 A1 3/2017

* cited by examiner

*Primary Examiner* — Anh T Vo
(74) *Attorney, Agent, or Firm* — Foley & Lardner LLP

(57) ABSTRACT

A printing apparatus capable of properly drying a medium includes a printing mechanism configured to print an image on the medium with a desired number of passes, a medium transporter configured to intermittently transport the medium by a transportation amount based on the desired number of passes of the printing mechanism, and a dryer configured to heat the medium on which printing has been performed by discharging a liquid from the printing mechanism. The plurality of patches with a different amount of liquid discharged from the printing mechanism are printable on the medium. The plurality of patches include a reference patch and a pseudo patch. The reference patch includes a first amount of liquid, and the pseudo patch includes a second amount of liquid that is determined with reference to the first amount of liquid, based on numbers of passes settable in the printing mechanism.

15 Claims, 4 Drawing Sheets

PRINTING APPARATUS AND ADJUSTMENT METHOD OF PRINTING APPARATUS

CROSS-REFERENCE TO RELATED APPLICATIONS

This application claims the benefit of and priority to Japanese Patent Application No. 2017-130291, filed on Jul. 3, 2017, the entire contents of which are incorporated herein by reference.

BACKGROUND

1. Technical Field

The present disclosure relates to a printing apparatus such as an ink jet printer and an adjustment method of the printing apparatus.

2. Related Art

There is a printing apparatus including a transport unit that intermittently transports a medium, a printing unit that discharges liquid onto the medium to print an image including characters, pictures, and the like on the medium, and a drying unit that dries the medium by heating to accelerate fixing of the printed image. International publication WO 2017/033327, which is an example of such a printing apparatus, discloses a printer that prints a patch chart in which a discharge rate of liquid per unit area gradually changes on a medium. The printer measures the printed patch chart with a colorimeter to obtain a saturated amount of liquid on the medium. Obtaining such a saturated amount of liquid on the medium enables printing with accurate color reproduction of liquid.

The saturated amount of liquid differs depending on the type of medium. Specifically, for printing with accurate color reproduction, an appropriate discharge rate of liquid differs depending on the type of medium. A change in the discharge rate of liquid leads to a change in a heating time of the drying unit for drying the medium. Accordingly, in changing the discharge rate of liquid, the heating time of the drying unit may be adjusted.

SUMMARY

In some embodiments according to one aspect, a printing apparatus and an adjustment method of the printing apparatus that are capable of properly drying a medium are provided.

A printing apparatus according to one exemplary embodiment may include a printing mechanism configured to print an image on a medium with a desired number of passes, a medium transporter configured to intermittently transport the medium by a transportation amount based on the desired number of passes of the printing unit, and a dryer configured to heat the medium on which printing has been performed by discharging a liquid from the printing mechanism. A plurality of patches with a different amount of liquid discharged from the printing mechanism may be printable on the medium. The plurality of patches may include a reference patch and a pseudo patch. The reference patch may include a first amount of liquid, and the pseudo patch may include a second amount of liquid that is determined with reference to the first amount of liquid, based on numbers of passes settable in the printing mechanism.

In some embodiments according to one aspect, a heating time for which the plurality of patches are heated by the dryer may be determined by a transportation amount per one time of the medium transporter configured to intermittently transport the medium. The transportation amount per one time of the medium transporter configured to intermittently transport the medium may be determined by the number of passes of the printing mechanism. Accordingly, the reference patch and the pseudo patch, which are included in the plurality of patches to be printed on the medium, can be evenly heated for the heating time determined by the number of passes of the printing mechanism.

In some embodiments according to one aspect, the pseudo patch may include the amount of liquid that is determined with reference to the amount of liquid of the reference patch, based on number of passes available in the printing mechanism. For example, assuming that the pseudo patch includes an amount of liquid smaller than the amount of liquid of the reference patch, after the patches are evenly heated by the dryer, the pseudo patch is fully dried but the reference patch is not fully dried in some cases. An amount of evaporation of liquid by heating caused by the dryer may be determined by the heating time of the dryer for the medium. Accordingly, the difference in amount of liquid between the reference patch and the pseudo patch to be formed can be regarded or used as the difference in heating time of the dryer between the reference patch and the pseudo patch to be dried. In other words, by varying the amount of liquid to form the pseudo patch, instead of the heating time determined by the number of passes of the printing mechanism, the pseudo patch may serve as a pseudo patch to be dried for a different heating time from the reference patch.

For example, by making the amount of liquid of the pseudo patch smaller than the amount of liquid of the reference patch, the pseudo patch can be regarded as a pseudo patch, a heating time of which is set to be longer than the heating time for the reference patch. By making the amount of liquid of the pseudo patch larger than the amount of liquid of the reference patch, the pseudo patch can be regarded as a pseudo patch, a heating time of which is set to be shorter than the heating time for the reference patch.

As a result, with the configuration described above, by checking the dry condition of the patches including the reference patch and the pseudo patch, a drying time for drying an image in printing the image with a desired amount of liquid can be determined or found. Therefore, the medium can be properly dried.

In some embodiments according to one aspect, in the printing apparatus, the second amount of liquid of the pseudo patch may be determined, based on a difference between the number of passes set in the printing mechanism and another number of passes different from the number of passes set in the printing mechanism, out of numbers of passes available in the printing mechanism.

With such a configuration, the pseudo patch can be regarded as a pseudo patch to be heated for a heating time in a case of printing with another number of passes different from the number of passes set in the printing mechanism. Therefore, with such a configuration, by checking the dry condition of the pseudo patch, the heating time of the dryer can be properly adjusted.

In some embodiments according to one aspect, in the printing apparatus, a plurality of pseudo patches may be formed to correspond to other numbers of passes different from the number of passes set in the printing mechanism.

With such a configuration, by checking the dry condition of the plurality of pseudo patches, the heating time of the dryer can be properly adjusted.

Further, in some embodiments according to one aspect, an adjustment method of a printing apparatus according to one exemplary embodiment includes printing a plurality of patches including a reference patch and a pseudo patch on a medium, the reference patch including a first amount of liquid, the pseudo patch including a second amount of liquid to be determined with reference to the amount of liquid, based on number of passes settable in a printing mechanism, and adjusting a heating time of a dryer configured to heat the medium intermittently transported by a medium transporter, based on a dry condition of the plurality of patches that have been subjected to drying by the dryer.

This method can provide a similar advantage as with the printing apparatus described above. In the adjustment method of the printing apparatus, after the heating time of the dryer is adjusted, the plurality of patches each with a different amount of liquid may be printed on the medium again.

This method enables checking whether the heating time of the dryer is properly adjusted, based on the dry condition of the patches that have been printed again.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
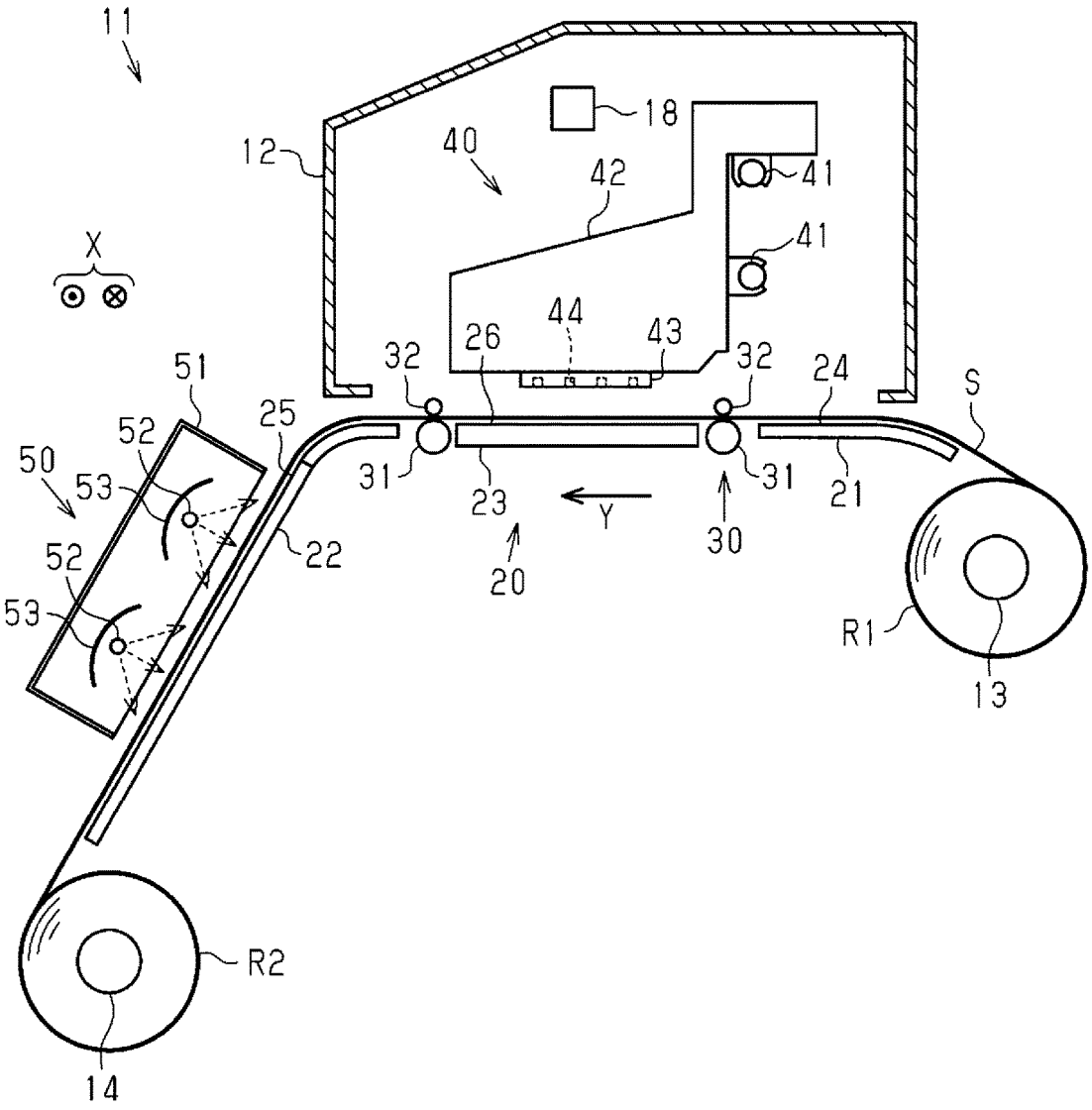
FIG. 1 is a schematic side view of a printing apparatus in one exemplary embodiment.

An exemplary embodiment of a printing apparatus is described below while referencing the accompanying drawings. The printing apparatus according to some exemplary embodiments is, for example, an ink jet-type printer. As illustrated in FIG. 1, the printing apparatus 11 includes a housing 12, a medium support unit (or a medium support) 20, and transport units (or medium transporters) 30 configured to transport a medium S in a transport direction Y along the medium support unit 20. The medium support unit 20 supports the medium S. A transport unit (or a medium transporter) 30 transports the medium S in the transport direction Y along the medium support unit 20. The printing apparatus 11 includes a printing unit (or a printing mechanism) 40 and a drying unit (a dryer) 50. The printing unit 40 prints an image including, but not limited to, characters or pictures on the medium S. The drying unit 50 can dry the medium S which has been subjected to printing by the printing unit 40. The printing apparatus 11 includes a feeding shaft 13 and a winding shaft 14. The printing apparatus 11 includes a controller 18 which integrally controls the operations of the printing apparatus 11. The feeding shaft 13 may feed the medium S toward the medium support unit 20. The winding shaft 14 may wind the medium S which has been subjected to printing by the printing unit 40.

The feeding shaft 13 may detachably support a roll body R1 in which the medium S has been laminated by winding. The feeding shaft 13 may rotate to wind off the medium S from the roll body R1 and thus to feed the medium S. In one exemplary embodiment, the medium S is a sheet of paper.

The medium support unit 20 includes a first guide portion 21, a second guide portion 22, and a support portion 23. The first guide portion 21, the second guide portion 22, and the support portion 23 may each be made of a plate member. The first guide portion 21 supports the medium S, which has been fed from the feeding shaft 13, to guide the medium S toward the inside of the housing 12. The support portion 23 supports the medium S, which has been guided by the first guide portion 21. The second guide portion 22 supports the medium S, which has passed on the support portion 23, to guide the medium S toward the outside of the housing 12. In other words, the first guide portion 21 is arranged upstream from the support portion 23 in the transport direction Y. The second guide portion 22 is arranged downstream from the support portion 23 in the transport direction Y. In some exemplary embodiments, the transport direction Y in which the medium S is transported indicates a direction in which the medium S moves on the medium support unit 20.

The first guide portion 21 and the second guide portion 22 have top surfaces serving as guide surfaces 24 and 25 to guide the medium S. The support portion 23 has a top surface serving as a support surface 26 to support the medium S.

In one exemplary embodiment, referring to FIG. 1, the support portion 23 is formed such that the support surface 26 extends horizontally. The first guide portion 21 and the second guide portion 22 are formed such that the guide surfaces 24 and 25 are partially bent against the support surface 26.

Referring to FIG. 1, two transport units 30 are included such that one transport unit 30 is arranged between the first guide portion 21 and the support portion 23 and the other transport unit 30 is arranged between the support portion 23 and the second guide portion 22, in the transport direction Y. The transport unit 30 includes driving rollers 31 and driven rollers 32. Each driving roller 31 is capable of driving a rotation. Each driven roller 32 is capable of being driven to rotate by the rotation of the corresponding driving roller 31. The transport unit 30 transports the medium S along the medium support unit 20 by the rotation of the driving roller 31 and the driven roller 32 with the medium S held by the driving roller 31 and the driven roller 32. In one exemplary embodiment, the driving roller 31 is arranged to be capable of contacting the medium S from below. The driven roller 32 is arranged to be capable of contacting the medium S from above.

The printing unit 40 is arranged inside the housing 12 to face the support portion 23. The printing unit 40 includes a guide shaft 41, a carriage 42, and a head 43. The guide shaft 41 extends in a width direction X of the medium S to be transported. The carriage 42 is supported by the guide shaft 41. The head 43 is installed in the carriage 42. The carriage 42 is movable along the guide shaft 41. In other words, the carriage 42 may be configured to be movable in the width direction X. In one exemplary embodiment, two guide shafts 41 are provided.

The head 43 is installed in the carriage 42 to be exposed on the bottom surface of the carriage 42. The head 43 includes a plurality of nozzles 44 configured to discharge ink as an example of liquid on its bottom surface facing the support portion 23. The head 43 discharges ink from any of the nozzles 44 onto the medium S supported by the support portion 23 to print an image on the medium S. The printing unit 40 according to one exemplary embodiment may be configured to discharge, for example, four color inks: cyan, magenta, yellow, and black.

Referring to FIG. 1, the drying unit 50 is arranged outside the housing 12 to face the second guide portion 22. The drying unit 50 includes a casing 51, a heating element 52, and a reflector plate 53. The casing 51 accommodates the heating element 52 and the reflector plate 53. In some embodiments, the casing 51 has a box shape and includes an opening facing the guide surface 25 of the second guide portion 22. The heating element 52 can generate heat by electric current flowing in. In one exemplary embodiment, two heating elements 52 are each formed from, for example, a rod heater extending in the width direction X, and are arranged to be spaced from each other in the transport direction Y. The reflector plate 53 is a plate member which is bent to surround an upper portion of the heating element 52. The reflector plate 53 reflects infrared rays generated by the heating element 52 toward the guide surface 25 of the second guide portion 22.

The drying unit 50 heats the medium S located on the guide surface 25 of the second guide portion 22 by heat generated by the heating element 52. In this way, solvent components such as water contained in ink can be evaporated by heating caused by the drying unit 50, and the medium S can be dried. This drying can accelerate fixing of the image printed on the medium S. The drying unit 50 may be configured to change the heating temperature for heating the medium S. A drying capability of the drying unit 50 to dry the medium S may be determined by a heating time for heating the medium S. In the drying unit 50 according to one exemplary embodiment, a heating temperature of 60° C. is set as initial setting. The drying unit 50 may heat the medium S so that the temperature of the medium S becomes equal to the set heating temperature. For example, in the case of the heating temperature of 60° C. being set, the drying unit 50 heats the medium S so that the temperature of the medium S becomes equal to around 60° C.

Rotation of the winding shaft 14 may wind the medium S which has been heated by the drying unit 50. The winding of the medium S onto the winding shaft 14 may produce a roll body R2. The winding shaft 14 may detachably hold the roll body R2. The printing apparatus 11 according to one exemplary embodiment may be configured to perform printing on not only continuous paper to be fed from the roll body R1 but also cut paper.

In one exemplary embodiment, the width direction X of the medium S corresponds to the longitudinal direction of the feeding shaft 13. The feeding shaft 13 whose longitudinal direction corresponds to a shaft direction rotates to feed the medium S. Accordingly, the medium S can be fed from the feeding shaft 13 in the circumferential direction of the feeding shaft 13. The medium S which has been fed from the feeding shaft 13 may move along the medium support unit 20 in the transport direction Y. In other words, the movement of the medium S along the medium support unit 20 may be referred to as the movement in the circumferential direction of the feeding shaft 13. The longitudinal direction and the circumferential direction of the feeding shaft 13 indicate different directions from each other. In other words, in one exemplary embodiment, the width direction X and the transport direction Y indicate different directions from each other.

In one exemplary embodiment, the printing unit 40 prints an image on the medium S with the head 43 moving along with the carriage 42 back and forth. In some embodiments, the transport unit 30 may stop transporting the medium S while the printing unit 40 is moving over the medium S in the width direction X, that is, while the printing unit 40 is scanning the medium S.

When the printing unit 40 finishes moving over the medium S, for example, when the printing unit 40 passes over the medium S and then is positioned at an internal edge of the housing 12 in the width direction X, the transport unit 30 may transport the medium S by a given amount. In this way, the transport unit 30 may alternately rotate and stop the driving roller 31 to intermittently transport the medium S. The transport unit 30 according to one exemplary embodiment may transport the medium S by a given amount every time the printing unit 40 moves over the medium S in the width direction X. In other words, the medium S may be transported by a given amount every time the printing unit 40 has scanned the medium S once.

Next, a printing method by the printing apparatus 11 according to one exemplary embodiment for performing a printing operation on the medium S will be described with reference to FIG. 2 and FIG. 3. In the following, a printing region T indicates each of a plurality of regions into which a region to be subjected to printing on the medium S is divided in the transport direction Y. In one exemplary embodiment, particularly, the printing region T is, for example, defined as each of a plurality of regions into which a region to be subjected to printing on the medium S is divided at regular intervals in the transport direction Y.

The printing apparatus 11 according to one exemplary embodiment may be configured to change the number of passes by the printing unit 40, which prints an image on the medium S. In one exemplary embodiment, the number of passes by the printing unit 40 indicates the number of times that the printing unit 40 performs a printing operation on one printing region T. In other words, the number of passes may be referred to as the number of times that the printing unit 40 scans one printing region T. An image to be printed on one printing region T may be formed by performing of a printing operation for the number of passes set in the printing unit 40.

Figure 2:
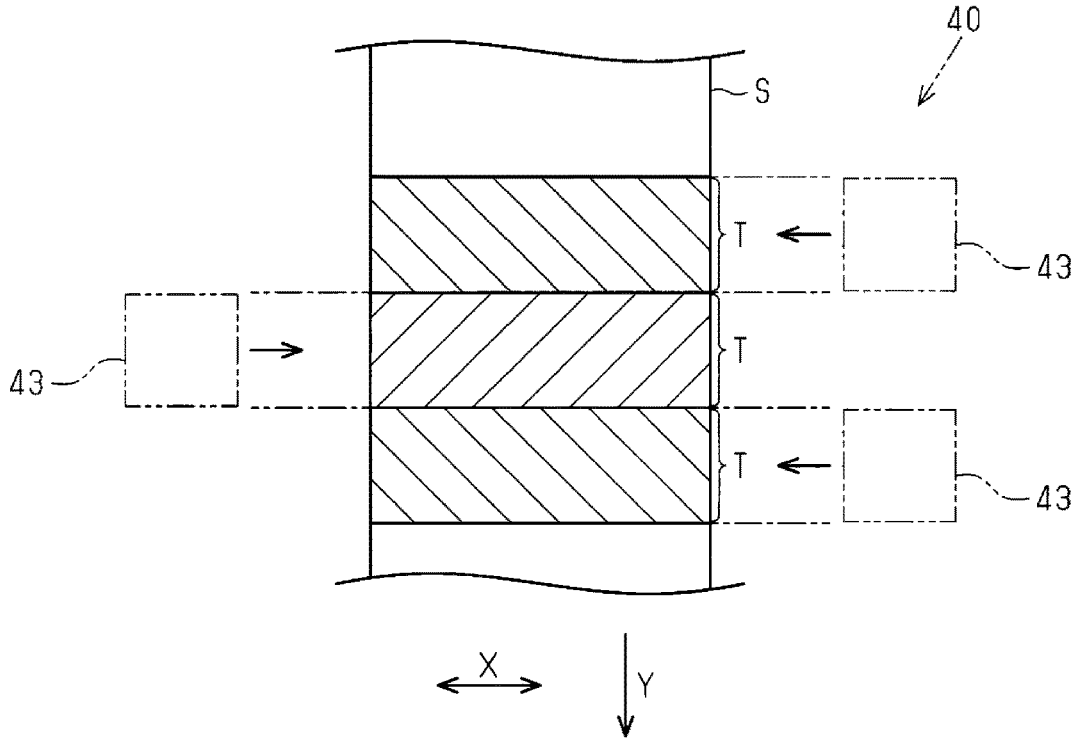
FIG. 2 is a plan view illustrating an operation of a printing unit (or a print mechanism) in one-pass printing according to one exemplary embodiment.

FIG. 2 illustrates a manner in which the printing unit 40 performs one-pass printing on the medium S. As illustrated in FIG. 2, the printing unit 40 for the one-pass printing on the medium S performs a printing operation on one printing region T once. Specifically, in the one-pass printing on the medium S, the printing unit 40 scans one printing region T once. In the one-pass printing on the medium S, the printing unit 40 finishes printing on one printing region T for every one scanning. The medium S is transported by a length of the printing region T in the transport direction Y for every scanning process by the printing unit 40.

Figure 3:
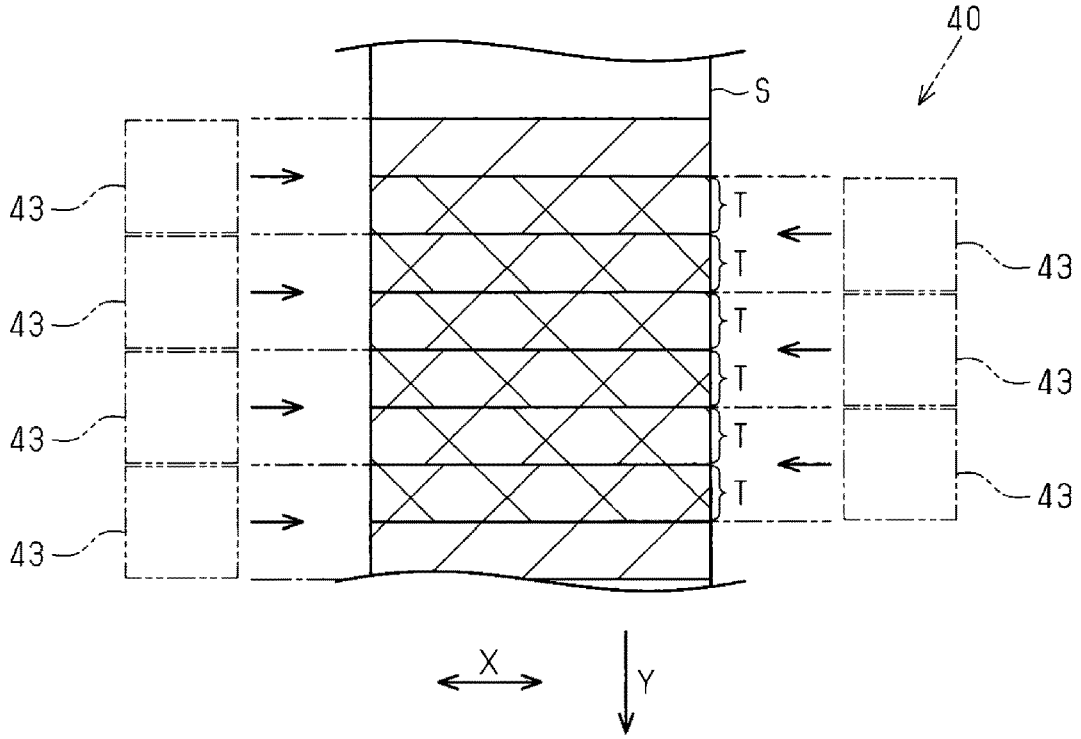
FIG. 3 is a plan view illustrating an operation of the printing unit (or a print mechanism) in two-pass printing according to one exemplary embodiment.

FIG. 3 illustrates a manner in which the printing unit 40 performs two-pass printing on the medium S. As illustrated in FIG. 3, in the two-pass printing on the medium S, the printing unit 40 performs a printing operation on one printing region T twice. Specifically, in the two-pass printing on the medium S, the printing unit 40 scans one printing region T twice. In the two-pass printing on the medium S, the printing unit 40 finishes printing on one printing region T for every two scanning processes. The medium S is transported by a length of the printing region T in the transport direction Y for every two scanning processes by the printing unit 40.

In the printing apparatus 11 according to one exemplary embodiment, the larger the number of passes by the printing unit 40 is, the higher the quality of an image printed on the medium S is. In the printing unit 40, when the head 43 is manufactured, the nozzles 44 of the head 44 may vary in position. The landing position of ink discharged from each nozzle 44 may depend on the positional accuracy of the nozzle 44. For that reason, the variations of positions of the nozzles 44 may cause variations of landing positions of ink. For example, in the one-pass printing, since the printing unit 40 prints an image on one printing region by performing a printing operation just once, the variations of positions of the nozzles 44 may cause uneven printing such as banding on the printed image.

By contrast, in the two-pass printing on a medium, since the printing unit 40 prints an image on one printing region by performing the printing operation twice, the variations of landing positions of ink can be made uniform, as compared with the one-pass printing. Accordingly, by performing the printing operation multiple times to print an image, uneven printing due to variations of positions of the nozzles 44 can be reduced, and thus the quality of the image can be increased. The printing apparatus 11 according to one exemplary embodiment is capable of selecting the number of passes for the printing unit 40, from among one-pass, two-pass, three-pass, four-pass, and five-pass. In other words, the numbers of passes available (or settable) in the printing unit 40 in one exemplary embodiment are one-pass, two-pass, three-pass, four-pass, and five-pass.

As illustrated in FIG. 2 and FIG. 3, a transportation amount per one time for intermittently transporting the medium S in the transport unit 30 is equal to a length of the printing region T in the transport direction Y. In the two-pass printing, the length of the printing region T in the transport direction Y may be about a half the length for the one-pass printing. In other words, in the two-pass printing, a transportation amount by the transport unit 30 per one time for intermittently transporting the medium S in every scanning process by the printing unit 40 may be about a half the transportation amount per one time for the one-pass printing.

As the transportation amount by the transport unit 30 per one time for intermittently transporting the medium S becomes smaller, a transportation time to transport the medium S may become longer. For example, in the two-pass printing, the transportation time to transport the medium S may be about twice the transportation time for the one-pass printing. The shorter the transportation time is, the higher the productivity of the printing apparatus 11 is in printing an image on the medium S. That is, the processing speed of the printing apparatus 11 can be increased. For example, the printing apparatus 11 according to one exemplary embodiment may be configured to select the processing speed from five levels. In one exemplary embodiment, the processing speed at which the printing unit 40 performs the one-pass printing is maximum, whereas the processing speed at which the printing unit 40 performs the five-pass printing is minimum.

In one exemplary embodiment, as the transportation amount per one time for intermittently transporting the medium S becomes longer, the heating time of the drying unit 50 for heating the medium S may become longer accordingly. For that reason, an approximately doubled increase in the transportation time by the transport unit 30 may result in an approximately doubled increase in the heating time of the drying unit 50 for heating the medium S. Accordingly, in one exemplary embodiment, the heating time of the drying unit 50 may be determined by the number of passes for the printing unit 40.

In other words, in a case where the printing unit 40 prints an image by N-pass printing (N=1, 2, 3, 4, 5), the transportation amount for intermittently transporting the medium S in the transport unit 30 for every one scanning by the printing unit 40 may be about 1/N of the transportation amount for one-pass printing. Accordingly, the transportation amount per one time of the transport unit 30 to intermittently transport the medium S is based on the number of passes.

In a case where the printing unit 40 prints an image by N-pass printing (N=1, 2, 3, 4, 5), the heating time of the drying unit 50 may be about N times the heating time for the one-pass printing. In other words, in the case where the printing unit 40 prints an image with the N-pass, the processing speed of the printing apparatus 11 may be about 1/N of the processing speed for the one-pass printing.

Some heating temperatures of the drying unit 50 may cause dry damage, such as waving and warping, to the medium S. Particularly, in a case where the medium S including a relatively low heat-resistant material such as polyvinyl chloride is subject to printing, since the medium S is more susceptible to heat damage, the heating temperature of the drying unit 50 may be set to a low degree. However, a low-heating temperature of the drying unit 50 may result in insufficient drying of the medium S, and thus the ink discharged on the medium S may not be fully dry. For that reason, the printing apparatus 11 according to one exemplary embodiment may be configured to adjust the heating time of the drying unit 50 to be capable of properly drying the medium S.

Next, processes for adjusting the heating time of the drying unit 50 included in the printing apparatus 11, which is configured as described above, will be described. To begin with, a user may determine a processing speed of the printing apparatus 11 to cause the printing apparatus 11 to print an image. The user may select and determine the number of passes corresponding to a desired processing speed from, for example, five levels indicative of the numbers of passes, which are selectable in the printing apparatus 11 according to one exemplary embodiment. In other words, the user may first determine the number of passes for the printing unit 40 from, for example, five of the numbers of passes to be selectable in the printing apparatus 11 to cause the printing apparatus 11 to print the image. The user may set the selected number of passes of the printing unit 40 as the processing speed in the printing apparatus 11. That number of passes of the printing unit 40 may be set via either an operation unit such as buttons or a touch panel of the printing apparatus 11 or an external terminal such as a computer. In the printing unit 40 according to one exemplary embodiment, the number of passes may be set to one-pass as initial setting.

Next, the user may determine a color density of the image to be printed. Accordingly, the printing apparatus 11 according to one exemplary embodiment is capable of changing the color density to print the image. To determine the color density of the image, the user may cause the printing apparatus 11 to print a color pattern 60 (see FIG. 4) to check the degree of coloring of ink on the medium S. Then, the printing apparatus 11 may print the color pattern 60 on the medium S at the number of passes set by the user.

Figure 4:
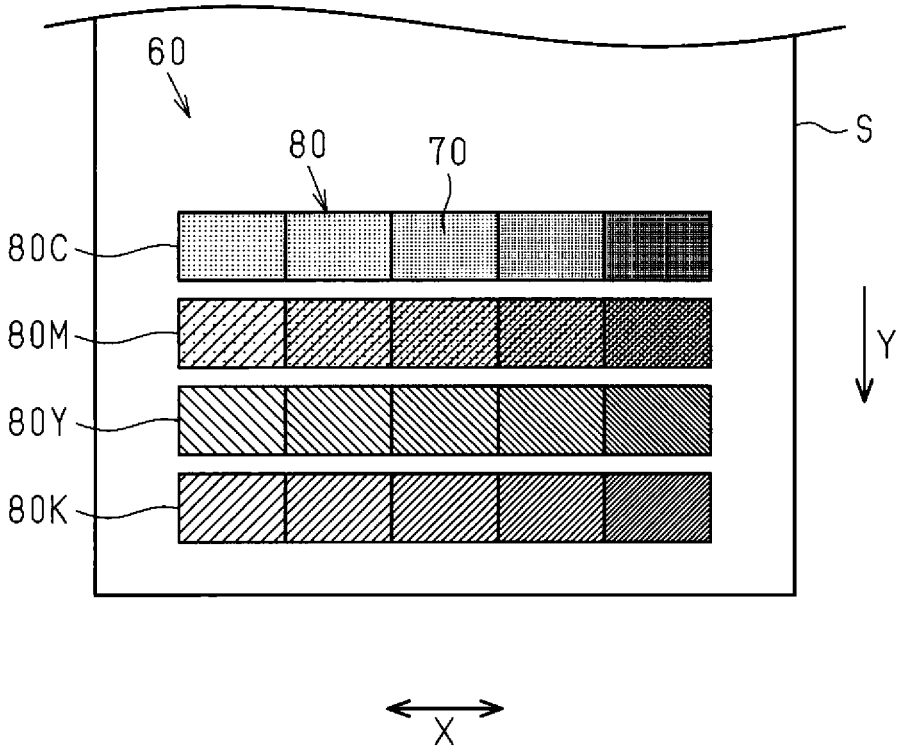
FIG. 4 illustrates an example of a color pattern.

As illustrated in FIG. 4, the color pattern 60 includes a patch group 80, in which a plurality of patches 70 each indicating a single hue are serially arranged in the width direction X. The color pattern 60 according to one exemplary embodiment includes a plurality of patch groups 80. For example, the color pattern 60 may include four patch groups 80 in total, which are arranged in the transport direction Y. The color pattern 60 may include a patch group 80C for cyan, a patch group 80M for magenta, a patch group 80Y for yellow, and a patch group 80K for black, which are sequentially arranged in order from upstream to downstream in the transport direction Y. The patch groups 80C, 80M, 80Y, and 80K respectively correspond to cyan, magenta, yellow, and black ink, which are each a single color.

In some embodiments, each patch group 80 includes the plurality of patches 70, which have different color densities from each other and which are arranged in the width direction X. Referring to FIG. 4, the patch group 80 according to one exemplary embodiment includes five patches 70. In some embodiments, the patch group 80 is made up of the patches 70, which may be sequentially arranged in order from the left to the right in the width direction X in FIG. 4 as the color density of the patches 70 gradually increases. Accordingly, in the patch group 80, the patch 70 located at the left end in the width direction X in FIG. 4 may have the lowest color density, whereas the patch 70 located at the right end may have the highest color density. In other words, the patch group 80 may indicate gradations of one hue.

The patches 70, which constitute the patch group 80, may be formed to correspond to color densities to be selectable in the printing apparatus 11. In other words, the color pattern 60 according to one exemplary embodiment includes the plurality of patches 70, which respectively indicate different hues in the transport direction Y and which are arranged to have different color densities from each other in the width direction X. The patches 70, which constitute the patch group 80, may be provided to correspond to color densities to be selectable in the printing apparatus 11. For example, the printing apparatus 11 according to one exemplary embodiment is capable of changing the color densities of the image among five levels.

In one exemplary embodiment, the scale of color density to be selectable for the image in the printing apparatus 11 is referred to as a color density level. For example, as shown in FIG. 4, the printing apparatus 11 according to one exemplary embodiment is capable of selecting a color density of the image from color density levels 1 to 5. The higher the color density level is, the higher the color density is.

Referring to FIG. 4, the patches 70, which constitute the patch group 80, are formed at color density level 1, color density level 2, color density level 3, color density level 4, and color density level 5 in order from the left to the right in the width direction X in FIG. 4. The higher the color density level of the patch 70 is, the denser the color of the patch 70 printed is. The printing apparatus 11 may print the color pattern 60 to form the patch 70 along with an identifier indicating the color density of the patch 70 so that the user easily identifies the color density of the patch 70.

The color density of the image may be determined by an amount of ink discharged onto the medium S per unit area. Accordingly, the more the amount of ink discharged per unit area is, the higher the color density of ink is. In one exemplary embodiment, an amount of ink discharged from the printing unit 40 onto the medium S per unit area is referred to as a liquid amount. Specifically, the printing apparatus 11 may print on the medium S the plurality of patches 70 each having a different liquid amount of ink to print the color pattern 60. In other words, a color density level indicates the scale of liquid amount.

In one exemplary embodiment, the color density level may be set to have a linear relationship with the liquid amount. For example, the liquid amount corresponding to color density level 3 may be set to three times the liquid amount corresponding to color density level 1. The liquid amount corresponding to color density level 5 may be set to five times the liquid amount corresponding to color density level 1. For that reason, the difference in liquid amount between adjacent patches 70 of the patch group 80 may be constant. The patch group 80 may include the patches 70, which are sequentially arranged in order from the left to the right in the width direction X in FIG. 4 such that the liquid amount of the patches 70 constantly increases.

The user may visually check the printed color pattern 60 to identify the degree of coloring of the patches 70. The user may select one of the patches 70 with a desired color from the printed color pattern 60 to determine a color density of the image.

The user may set the selected color density of the patch 70 as the color density level in the printing apparatus 11. For example, the user may set a desired one of color density levels 1 to 5 in the printing apparatus 11. The color density of the image may be set via either an operation unit such as buttons or a touch panel of the printing apparatus 11 or an external terminal such as a computer.

When the color density of the image is set, the liquid amount of ink to be discharged from the printing unit 40 may be changed to correspond to the color density selected by the user. In other words, the user may select and determine the liquid amount to be discharged from the printing unit 40 to cause the printing apparatus 11 to print the image. In the printing unit 40 according to one exemplary embodiment, the liquid amount (color density of an image) may be set to a liquid amount corresponding to color density level 1 as initial setting.

In some embodiments, to cause the printing apparatus 11 to print the image, the user may first select the number of passes of the printing unit 40 as a desired processing speed and then select a color density of the image from the color pattern 60. Accordingly, at this timing, the liquid amount of ink to be discharged onto the medium S, and the heating temperature and the heating time of the drying unit 50 for the medium S may be determined.

In one exemplary embodiment, an amount of ink to be evaporated by heating caused by the drying unit 50 may be determined by the heating temperature and/or the heating time of the drying unit 50. In one exemplary embodiment, an evaporation amount refers to an amount of ink per unit area to be evaporated from the medium S by heating of the drying unit 50. The ink discharged onto the medium S may be partially absorbed by the medium S. In one exemplary embodiment, an absorbed amount refers to an amount of ink per unit area to be absorbed by the medium S out of ink discharged onto the medium S from the printing unit 40. The medium S may absorb the ink until the ink is heated by the drying unit 50 after the ink is discharged from the printing unit 40. The absorbed amount by the medium S may depend on the type of medium S.

To dry the medium S and fix the printed image, ink remaining on the surface of the medium S out of the ink discharged from the printing unit 40 may be evaporated. However, in a case where an image is printed on the medium S having a low heat-resistance, an increased heating temperature to evaporate the ink may cause heat damage to the medium S. For that reason, in one exemplary embodiment, the heating time of the drying unit 50 may be adjusted to fully dry the medium S so that heat damage to the medium S can be reduced.

To dry the medium S, the heating time of the drying unit 50 may be set so as to satisfy evaporation amount≥(liquid amount−absorbed amount). To reduce heat damage to the medium S, the heating time of the drying unit 50 may be set so as to satisfy evaporation amount=(liquid amount−absorbed amount).

Next, in the case where an image is printed at the color density (or liquid amount) of the patch 70 selected from the color pattern 60, the user may check whether the current heating time or the selected number of passes of the printing unit 40 makes the image dry. For this purpose, the user may cause the printing apparatus 11 to print a check pattern 90 for checking the dry condition of the medium S (see FIG. 5). For example, the printing apparatus 11 may print the check pattern 90 on the medium S at the number of passes set by the user, as in the case of the color pattern 60.

Figure 5:
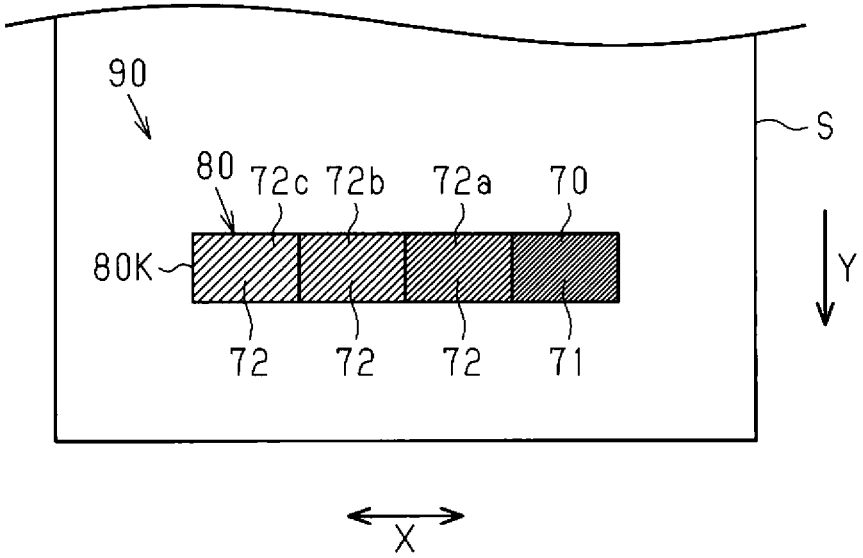
FIG. 5 illustrates an example of a check pattern.

As illustrated in FIG. 5, the check pattern 90 includes a patch group 80 in which a plurality of patches 70 each indicating a single hue are serially arranged in the width direction X. In one exemplary embodiment, the check pattern 90 is made up of one patch group 80, which is different from the color pattern 60. The check pattern 90 is made up of, for example, a patch group 80K for black.

Referring to FIG. 5, the patch group 80 of the check pattern 90 includes a reference patch 71 and a pseudo patch 72. In the patch group 80, one reference patch 71 is provided. In the patch group 80, a plurality of pseudo patches 72 are provided. The patch group 80 includes the reference patch 71 and the pseudo patches 72, which are arranged in the width direction X. In one exemplary embodiment, in the patch group 80, the reference patch 71 is located at the right end in the width direction X in FIG. 5.

Referring to FIG. 5, the patch group 80 of the check pattern 90 is made up of the patches 70, which are sequentially arranged in order from the left to the right in the width direction X in FIG. 5, as the color density of the patches 70 gradually increases. For example, by printing on the medium S the plurality of patches 70 each having a different liquid amount of ink, the printing apparatus 11 prints the check pattern 90.

The reference patch 71 may be formed at the color density level selected by the user. For example, when the user selects color density level 5 from the color pattern 60, the reference patch 71 is formed with a liquid amount corresponding to color density level 5. Accordingly, the liquid amount corresponding to the color density level selected by the user indicates a desired liquid amount that the user desires. In other words, the check pattern 90 is made up of the plurality of patches 70, which may include the patch 70 printed at a liquid amount corresponding to the color density level selected by the user.

The reference patch 71 is a patch 70, with which the user is able to check the dry condition when an image is formed with the number of passes selected by the user and at the color density level selected by the user. The printing apparatus 11 may print the check pattern 90 to form the reference patch 71 along with a mark (not shown in the drawings) for identifying the reference patch 71 so that the user easily identifies the reference patch 71 in the patch group 80.

The pseudo patches 72 may be formed to correspond to any number of passes different from the number of passes selected by the user, out of the numbers of passes to be selectable in the printing apparatus 11. In one exemplary embodiment, the pseudo patches 72 may be formed to correspond to the numbers of passes greater than the number of passes selected by the user, out of the numbers of passes to be selectable in the printing apparatus 11. For example, when the user selects two-pass printing, three pseudo patches 72 in total (e.g., 72*a*, 72*b*, 72*c* in FIG. 5) are formed to correspond to three-pass printing, four-pass printing, and five-pass printing, which are each greater than the two-pass printing, as illustrated in FIG. 5. The printing apparatus 11 may print the check pattern 90 to form the pseudo patches 72 along with marks (not shown in the drawings) for identifying the pseudo patches 72 so that the user easily identifies the pseudo patches 72 in the patch group 80. In some implementations, the number of passes corresponding to each pseudo patch 72 is also identifiable.

Each pseudo patch 72 may be formed with a liquid amount that is determined, based on the liquid amount of the reference patch 71, depending on the corresponding number of passes. The pseudo patch 72 is a patch 70, with which the user is able to check, in a pseudo manner, the dry condition when an image is formed with the corresponding number of passes and at the color density level selected by the user.

The reference patch 71 and the pseudo patches 72 may be evenly heated as the check pattern 90 by the drying unit 50 for the heating time based on the number of passes selected by the user. The evaporation amount of ink caused by the drying unit 50 may be determined by the heating temperature and the heating time of the drying unit 50. Accordingly, a shorter heating time of the drying unit 50 may lead to a smaller evaporation amount of ink, whereas a longer heating time of the drying unit 50 may lead to a larger evaporation amount of ink. In one exemplary embodiment, the heating time of the drying unit 50 may be determined by the number of passes of the printing unit 40. Accordingly, a smaller number of passes of the printing unit 40 may lead to a smaller evaporation amount of ink, whereas a larger number of passes of the printing unit 40 may lead to a larger evaporation amount of ink. In other words, out of the patches 70 constituting the patch group 80, a patch 70 with a smaller liquid amount may be regarded as a patch in which a larger amount of ink has been evaporated by heating caused by the drying unit 50. As a result, a difference in liquid amount between the patches 70 constituting the patch group 80 can be regarded or used as a difference in heating time.

The pseudo patch 72 with a liquid amount smaller than the liquid amount of the reference patch 71 can be regarded as a pseudo patch for which a heating time is set longer than a heating time for the reference patch 71. The pseudo patch 72 with a liquid amount larger than the liquid amount of the reference patch 71 can be regarded as a pseudo patch for which a heating time is set shorter than a heating time for the reference patch 71. In other words, in the check pattern 90, the pseudo patch 72 can be regarded as a pseudo patch which has been heated for a different heating time from a heating time for the reference patch 71. Accordingly, the pseudo patch 72 can serve as a patch 70, with which the user is able to check the dry condition when an image with a color density level selected by the user is printed with a number of passes different from the number of passes selected by the user.

In one exemplary embodiment, the pseudo patches 72 constituting the patch group 80 are denoted by symbols of pseudo patches 72*a*, 72*b*, and 72*c*, in order from the right to the left in the width direction X in FIG. 5. The pseudo patch 72*a* may be formed to correspond to three-pass printing, the pseudo patch 72*b* to four-pass printing, and the pseudo patch 72*c* to five-pass printing.

The pseudo patch 72*a* may be a patch 70, with which the user is able to check whether an image is dried in the heating time while the printing unit 40 prints the image in the three-pass printing at color density level 5, if it is the color density level selected by the user before printing. The pseudo patch 72*b* is a patch 70, with which the user is able to check whether an image is dried in the heating time while the printing unit 40 prints the image in the four-pass printing at color density level 5, if it is the color density level selected by the user before printing. The pseudo patch 72*c* is a patch 70, with which the user is able to check whether an image is dried in the heating time while the printing unit 40 prints the image in the five-pass printing at color density level 5, if it is the color density level selected by the user before printing.

As a result, the plurality of patches 70, which constitute the check pattern 90, may be regarded as patches which have been heated for different heating times depending on the liquid amounts of the patches 70. In other words, in the check pattern 90, the plurality of patches 70 formed with an equal liquid amount may be configured to be heated for different heating times. A method of calculating the liquid amount of the pseudo patch 72 will be described later.

Next, the user may visually check the printed check pattern 90 to identify whether the reference patch 71, which is the selected patch 70 (e.g., which is formed at the color density level selected by the user), is fully dried. For example, the user may touch the reference patch 71 of the check pattern 90 with their finger (or other appropriate means, e.g., paper) to identify whether the touched reference patch 71 is dried. Each dry condition of the patches 70 may be determined, based on, for example, "Determination of through-dry state" standardized as JIS K5600-3-3.

In a case where the reference patch 71 is fully dried, it is found that when an image is printed at the color density of the reference patch 71, that is, when the image is printed with the liquid amount of the reference patch 71, in the current heating time of the drying unit 50, the image is dried. Conversely, in a case where the reference patch 71 is not fully dried, it is determined that when an image is printed with the liquid amount of the reference patch 71, the current heating time of the drying unit 50 is not enough to dry the image. In a case where the reference patch 71, which is the selected patch 70, is not fully dried, the user may adjust the heating time of the drying unit 50, that is, the number of passes of the printing unit 40, based on the dry condition of the check pattern 90. For example, the heating time of the drying unit 50 may be adjusted, based on the dry condition of the pseudo patches 72 of the check pattern 90.

The printing of the check pattern 90 through the printing apparatus 11 can enable the user to check in advance the dry condition of the medium S when an image is printed with the selected number of passes (or selected processing speed) and at the selected color density. As a comparative example, the user may check in advance the dry condition of the medium S by actually printing an image through the printing apparatus 11 with the selected number of passes and at the selected color density. In this case, however, in a case where the printed image is not fully dried, the user would need to adjust the heating time of the drying unit 50 by adjusting the number of passes, based on, for example, user's experience. Moreover, after adjusting the heating time of the drying unit 50 based on the user's experience, the user would need to cause the printing apparatus 11 to print an image again to check the dry condition. For example, the user may repeatedly perform printing of an image and adjusting of the heating temperature until the heating time becomes appropriate to dry the image, thereby consuming a significant amount of time. For that reason, printing an image on the medium S (instead of printing a check pattern) to check the dry condition of the medium S would often consume a more amount of medium S and a more amount of ink than printing the check pattern 90 to check the dry condition of the medium S.

The printing apparatus 11 according to one exemplary embodiment is capable of properly adjusting the heating time of the drying unit 50, based on the dry condition of the check pattern 90. Printing the check pattern 90 to check the dry condition of the medium S can also reduce the consumption of medium S and ink.

Next, the method of calculating liquid amounts of the pseudo patches 72, which constitute the check pattern 90, will be described. Here, it is assumed that the user has selected two-pass printing as the number of passes for the printing unit 40 and color density level 5 as the color density level of the image.

The liquid amount of each pseudo patch 72 may be calculated by the controller 18 included in the printing apparatus 11. The controller 18 may calculate the liquid amount of each pseudo patch 72 based on the number of passes of the printing unit 40 and the color density level which are selected by the user, for example, by referring to correspondence data stored in the controller 18. The correspondence data may be data indicating a correspondence relationship between the number of passes of the printing unit 40 and the evaporation liquid of ink caused by the drying unit 50.

Figure 6:
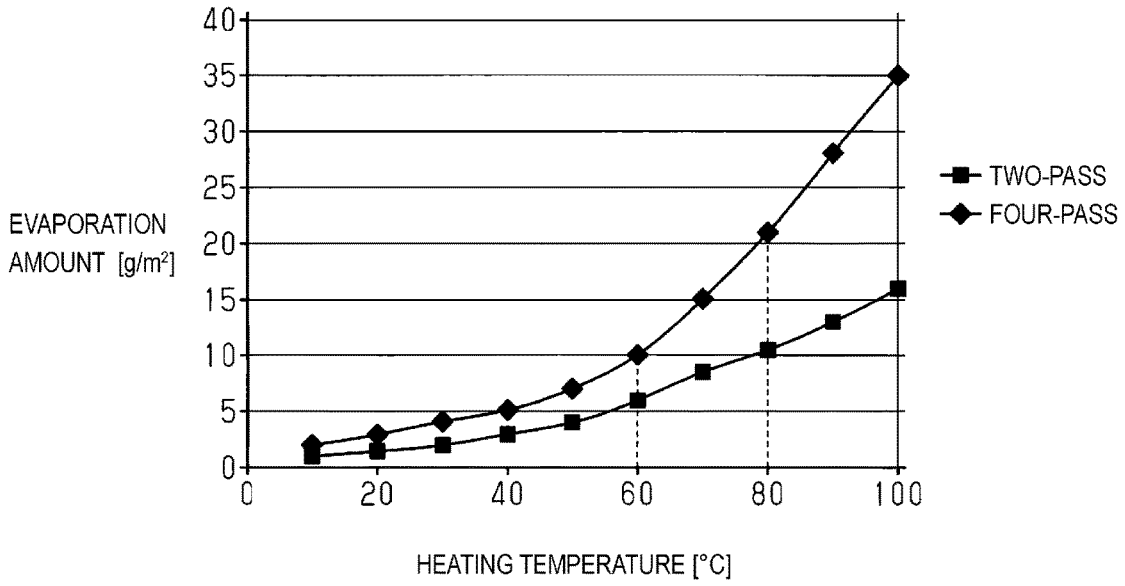
FIG. 6 is a graph of an example of correspondence data.

A graph illustrated in FIG. 6 is a graph illustrating correspondence relationships between a heating temperature of the drying unit 50 and an evaporation amount of ink caused by the drying unit 50 for a respective number of passes to be selectable in the printing apparatus 11. In other words, the graph illustrated in FIG. 6 is a graph indicating correspondence relationships between the number of passes of the printing unit 40 and the evaporation amount of ink caused by the drying unit 50 for the respective heating temperatures of the drying unit 50. In one exemplary embodiment, the graph in FIG. 6 illustrates a correspondence relationship in a case where the number of passes of the printing unit 40 is four-pass and a correspondence relationship in a case where the number of passes is two-pass, as typical examples. In some embodiments, that graph may be stored as an example of the correspondence data in the controller 18.

As illustrated in FIG. 6, the evaporation amount of ink increases with a larger heating temperature of the drying unit 50. The evaporation amount of ink also increases with a larger number of passes of the printing unit 40, that is, with a longer heating time. In view of the correspondence relationship between the heating time of the drying unit 50 and the evaporation amount of ink for the four-pass printing, the evaporation amount of ink in the case of a heating temperature of 60° C. is about 10 g/m$^2$; the evaporation amount of ink in a case of a heating temperature of 80° C. is about 21 g/m$^2$. In view of the correspondence relationship between the heating time of the drying unit 50 and the evaporation amount of ink for the two-pass printing, the evaporation amount of ink in the case of a heating temperature of 60° C. is about 6 g/m$^2$; the evaporation amount of ink in a case of a heating temperature of 80° C. is about 11 g/m$^2$. As illustrated in FIG. 6, in view of the correspondence relationship between the number of passes of the printing unit 40 and the evaporation amount of ink in the case of a heating temperature of 60° C., the evaporation amount of ink in the case where the number of passes of the printing unit 40 is four-pass is about 10 g/m$^2$, and the evaporation amount of ink in the case of two-pass is about 6 g/m$^2$. Further, in view of the correspondence relationship between the number of passes of the printing unit 40 and the evaporation amount of ink in the case of a heating temperature of 80° C., the evaporation amount of ink in the case where the number of passes of the printing unit 40 is four-pass is about 21 g/m$^2$, and the evaporation amount of ink in the case of two-pass is about 11 g/m$^2$.

In one exemplary embodiment, in a case where the liquid amount corresponding to color density level 1 is 5 g/m$^2$, the liquid amount corresponding to color density level 3 is 15 g/m$^2$, and the liquid amount corresponding to color density level 5 is 25 g/m$^2$. Accordingly, in one exemplary embodiment, the reference patch 71 is formed with a liquid amount of 25 g/m$^2$ (assuming that the user has selected two-pass printing as the number of passes for the printing unit 40, and color density level 5 as the color density level of an image). Now note the pseudo patch 72*b* to be formed to correspond to four-pass printing, out of the pseudo patches 72 of the check pattern 90.

In the check pattern 90, an amount of liquid is considered such that the pseudo patch 72*b* can be regarded as a pseudo patch 70 with color density level 5 that has been heated for the heating time while the printing unit 40 is performing four-pass printing. The pseudo patch 72*b* is heated by the drying unit 50 for the heating time in two-pass printing, as with the reference patch 71. Hence, the evaporation amount of ink evaporated from the pseudo patch 72*b* is equal to the evaporation amount of ink evaporated from the reference patch 71. To regard the pseudo patch 72*b* as a pseudo patch 70 with color density level 5 that has been heated for the heating time in four-pass printing, the pseudo patch 72*b* may be formed with such a liquid amount that an apparent evaporation amount of the pseudo patch 70 is equal to the evaporation amount in four-pass printing. In other words, the pseudo patch 72*b* may be formed with a liquid amount obtained by subtracting a difference in evaporation amount between two-pass printing and four-pass printing from the liquid amount corresponding to color density level 5. In this way, the pseudo patch 72*b* is regarded as the pseudo patch 70 with color density level 5 that has been heated for the heating time in four-pass printing.

Referring to the graph illustrated in FIG. 6, in the case of a heating temperature of 60° C., the evaporation amount in two-pass printing is about 6 g/m$^2$, and the evaporation amount in four-pass printing is about 10 g/m$^2$. Accordingly, the evaporation amount of the pseudo patch 72*b* is calculated as 25−(10−6)=21 g/m$^2$. As a result, the evaporation amount of each pseudo patch 72 is determined based on a difference between the number of passes set in the printing unit 40 and a different number of passes from the number of passes set in the printing unit 40.

The controller 18 may calculate liquid amounts of the pseudo patches 72*a* and 72*c* as in the case of the pseudo patch 72*b* and cause the printing unit 40 to print the check pattern 90. The controller 18 may calculate the liquid amounts of the pseudo patches 72, based on the number of passes and the color density that have been selected by the user, by referring to the correspondence data.

Referring to FIG. 6, in a case of a heating temperature of 80° C., the evaporation amount for two-pass printing is about 11 g/m$^2$, and the evaporation amount for four-pass printing is about 21 g/m$^2$. Accordingly, the evaporation amount of the pseudo patch 72*b* is calculated as 25−(21−11)=15 g/m$^2$.

Next, an adjustment method of the printing apparatus 11 to adjust the heating time of the drying unit 50 from the dry condition of the check pattern 90 will be described. Here, as in the case described above, it is assumed that the user has selected two-pass printing as the number of passes for the printing unit 40, and color density level 5 as the color density level of an image.

In a case where the reference patch 71 is not fully dried, the user may check whether the pseudo patches 72 are fully dried. For example, the user may touch the pseudo patches 72 of the check pattern 90 with their finger (or other appropriate means, e.g., paper) to identify whether the touched pseudo patch 72 is dried.

It is assumed that out of the pseudo patches 72 of the check pattern 90, the pseudo patch 72*a* is not fully dried but the pseudo patches 72*b* and 72*c* are fully dried, for example. In this situation, as a result of checking the dry condition of the pseudo patches 72, in a case where the number of passes of the printing unit 40 is four-pass or five-pass printing, the user can understand that the heating temperature of the drying unit 50 remaining unchanged dries the medium S. The user may change the number of passes of the printing unit 40 from two-pass printing to four-pass printing and adjust the heating time of the drying unit 50, based on the dry condition of the check pattern 90.

Next, in a case where an image is printed at a color density (or liquid amount) of the patch 70 which has been selected from the color pattern 60, the user may check whether the adjusted heating time of the drying unit 50, that is, the changed number of passes of the printing unit 40 dries the patch 70. The user may cause the printing apparatus 11 to print a check pattern 90 again for checking the dry condition of the medium S (see FIG. 7). For example, the printing apparatus 11 may print the check pattern 90 on the medium S with the number of passes that has been changed by the user.

Figure 7:
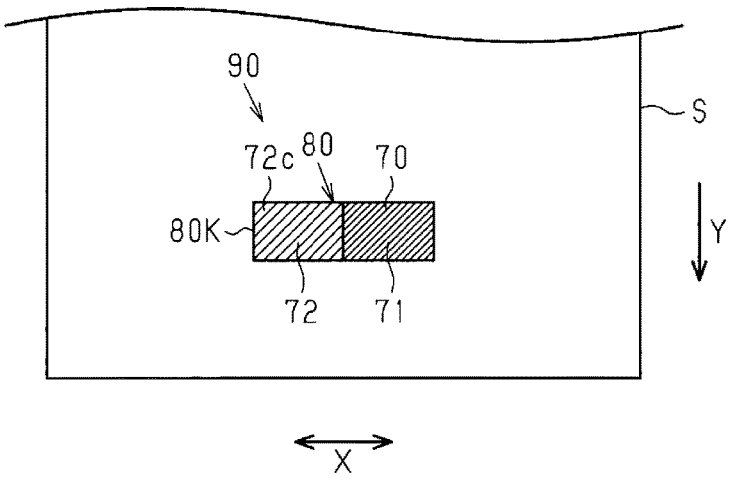
FIG. 7 is a plan view of a check pattern printed after the heating time is adjusted according to one exemplary embodiment.

As illustrated in FIG. 7, the check pattern 90 includes a patch group 80, in which a plurality of patches 70 each indicating a single hue are serially arranged in the width direction X. In one exemplary embodiment, since the number of passes of the printing unit 40 is changed to four-pass printing, the patch group 80 includes two patches—e.g., a reference patch 71 and a pseudo patch 72.

The reference patch 71 according to one exemplary embodiment may be formed with the liquid amount corresponding to color density level 5 that is the color density level that is selected by the user. The pseudo patch 72 may be formed to correspond to five-pass printing, which is larger than four-pass printing that has been selected by the user.

In some embodiments, the user may check the dry condition of the printed color pattern 90 again. In other words, the user may check whether the reference patch 71 is fully dried. At that time, in a case where the reference patch 71 is fully dried, it may be determined that the heating time of the drying unit 50 has been properly adjusted. In a case where the reference patch 71 is not fully dried, the number of passes of the printing unit 40 may be adjusted again, based on the dry condition of the check pattern 90.

According to some exemplary embodiments, the following advantages can be obtained.

(1) The heating time for which the patches 70 are heated by the drying unit 50 can be determined by a transportation amount per one time of the transport unit 30 to intermittently transport the medium S. The transportation amount per one time of the transport unit 30 to intermittently transport the medium S can be determined by the number of passes of the printing unit 40. Accordingly, the reference patch 71 and the pseudo patch(es) 72, which constitute the plurality of patches 70 to be printed on the medium S, can be evenly heated for the heating time that is determined, based on the number of passes of the printing unit 40.

The pseudo patch 72 can have an amount of liquid to be determined with reference to the liquid amount of the reference patch 71, depending on the number of passes that can be set in the printing unit 40. For example, assuming that the pseudo patch 72 has a liquid amount smaller than a liquid amount of the reference patch 71, after the patches 70 are evenly heated by the drying unit 50, the pseudo patch 72 is fully dried but the reference patch 71 is not fully dried in some cases. The evaporation amount of liquid by heating caused by the drying unit 50 can be determined by the heating time of the drying unit 50 for the medium S. Accordingly, the difference in liquid amount between the reference patch 71 and the pseudo patch 72 to be used can be regarded or used as the difference in heating time of the drying unit 50 between the reference patch 71 and the pseudo patch 72 to be heated and dried. In other words, by varying the liquid amount to constitute the pseudo patch 72 instead of the heating time to be determined by the number of passes of the printing unit 40, the pseudo patch 72 can serve as a pseudo patch 70 to be subject to drying by a different heating time from the reference patch 71.

For example, the liquid amount of the pseudo patch 72 may be set to be smaller than the liquid amount of the reference patch 71. The pseudo patch 72 can be regarded as a pseudo patch, a heating time of which is set to be longer than a heating time for the reference patch 71. The liquid amount of the pseudo patch 72 may be set to be larger than the liquid amount of the reference patch 71. The pseudo patch 72 can be regarded as a pseudo patch, a heating time of which is set to be shorter than the heating time for the reference patch 71.

As a result, with the configuration described above, a drying time for drying an image in printing the image with a desired amount of liquid can be determined or found by checking the dry condition of the patches 70 including the reference patch 71 and the pseudo patch 72. Therefore, the medium S can be properly dried.

(2) The liquid amount of the pseudo patch 72 can be determined, based on a difference between the number of passes set in the printing unit 40 and another number of passes different from the number of passes set in the printing unit 40, out of numbers of passes that can be set in the printing unit 40. Accordingly, the pseudo patch 72 can be regarded as a pseudo patch 70 to be heated for the heating time in a case of printing with another number of passes different from the number of passes set in the printing unit 40. Therefore, according to some exemplary embodiments as described above, the heating time of the drying unit 50 can be properly adjusted by checking the dry condition of the pseudo patch 72.

(3) A plurality of pseudo patches 72 can be formed to correspond to another number of passes different from the number of passes set in the printing unit 40. Accordingly, the heating time of the drying unit 50 can be more properly adjusted by checking the dry condition of the plurality of pseudo patches 72.

(4) After the heating time of the drying unit 50 is adjusted, the plurality of patches 70 each with a different amount of liquid can be printed on the medium again. This enables checking whether the heating time of the drying unit 50 is properly adjusted, based on the dry condition of the patches 70 printed again.

Some exemplary embodiments described above may be modified as follows. The following modifications may be combined with each other as appropriate.

The check pattern 90 may include a pseudo patch(es) which is/are formed to correspond to the number of passes smaller than the number of passes selected by a user.

As a scale indicating a liquid amount included in each patch 70, a print duty may be used instead of a color density level. The print duty indicates a coverage of liquid on the medium S, that is, an area ratio of areas occupied by liquid on the medium S to the medium S.

The printing apparatus 11 may be capable of selecting six or more passes for printing. The number of passes to be selectable in the printing apparatus 11 is not limited to one of consecutive numbers. For example, the selectable number of passes may be one of discrete numbers, such as one-pass, two-pass, four-pass, and eight-pass.

The patch group 80 in each of the color pattern 60 and the check pattern 90 is not limited to a configuration with a single color ink. For example, the patch group 80 may be formed by mixing different color inks. The printing apparatus 11 may be a fluid jet apparatus configured to jet or discharge fluid other than ink (including, for example, liquids, liquid materials obtained by dispersing or mixing particles of a functional material in a liquid, and fluid materials like a gel). For example, the printing apparatus 11 may be a liquid-material jet apparatus configured to jet a liquid material, which includes material such as an electrode material, or a color material (e.g., pixel material) used in the manufacture of liquid crystal displays, electroluminescence (EL) displays, surface emitting displays, and the like in a dispersed or dissolved form. The printing apparatus 11 may be a fluid-material jet apparatus configured to jet a fluid material such as a gel (e.g., physical gel). The disclosure can be applied to, but not limited to, one of such types of fluid jet apparatuses. In certain embodiments, as used herein, a "fluid" does not include a material in a purely gaseous form. The fluid may include, for example, liquids (inorganic solvent, organic solvent, solution, liquid resin, liquid metal, molten metal, and so on), liquid materials, and fluid materials.

What is claimed is:

1. A printing apparatus comprising:

a printing mechanism configured to print an image on a medium with a desired number of passes;

a medium transporter configured to intermittently transport the medium by a transportation amount based on the desired number of passes of the printing mechanism; and a dryer configured to heat the medium on which printing has been performed by discharging a liquid from the printing mechanism, wherein a plurality of patches with a different amount of liquid discharged from the printing mechanism are printable on the medium, the plurality of patches include a reference patch and a pseudo patch, the reference patch includes a first amount of liquid, and the pseudo patch includes a second amount of liquid that is determined with reference to the first amount of liquid, based on numbers of passes settable in the printing mechanism.

2. The printing apparatus according to claim 1, wherein the second amount of liquid of the pseudo patch is determined, based on a difference between the number of passes set in the printing mechanism and another number of passes different from the number of passes set in the printing mechanism, out of the numbers of passes settable in the printing mechanism.

3. The printing apparatus according to claim 2, wherein a plurality of pseudo patches are formed to correspond to other numbers of passes different from the number of passes set in the printing mechanism.

4. The printing apparatus according to claim 1, wherein the dryer is further configured to heat the plurality of patches for a heating time determined by a transportation amount per one time of the medium transporter configured to intermittently transport the medium.

5. The printing apparatus according to claim 4, wherein the transportation amount per one time of the medium transporter configured to intermittently transport the medium is determined by the number of passes set in the printing mechanism.

6. The printing apparatus according to claim 4, wherein the dryer is further configured to set a heating time for which is set to be shorter than a heating time for the reference patch by setting the second amount of liquid of the pseudo patch to be smaller than the first amount of liquid of the reference patch.

7. The printing apparatus according to claim 4, wherein the dryer is further configured to set a heating time for which is set to be longer than a heating time for the reference patch by setting the second amount of liquid of the pseudo patch to be larger than the first amount of liquid of the reference patch.

8. An adjustment method of a printing apparatus, the adjustment method comprising:

printing a plurality of patches including a reference patch and a pseudo patch on a medium, the reference patch including a first amount of liquid, the pseudo patch including a second amount of liquid to be determined with reference to the first amount of liquid, based on numbers of passes settable in a printing mechanism; and adjusting a heating time of a dryer configured to heat the medium intermittently transported by a medium transporter, based on a dry condition of the plurality of patches that have been subjected to drying by the dryer.

9. The adjustment method according to claim 8, further comprising:

printing on the medium, after the heating time of the dryer is adjusted, the plurality of patches each with a different amount of liquid.

10. The adjustment method according to claim 8, further comprising:

determining the second amount of liquid of the pseudo patch, based on a difference between a number of passes set in the printing mechanism and another number of passes different from the number of passes set in the printing mechanism, out of the numbers of passes settable in the printing mechanism.

11. The adjustment method according to claim 10, further comprising:

forming a plurality of pseudo patches to correspond to other numbers of passes different from the number of passes set in the printing mechanism.

12. The adjustment method according to claim 8, further comprising:

heating by a dryer, the plurality of patches for a heating time determined by a transportation amount per one time of the medium transporter configured to intermittently transport the medium.

13. The adjustment method according to claim 12, wherein the transportation amount per one time of the medium transporter configured to intermittently transport the medium is determined by a number of passes set in the printing mechanism.

14. The adjustment method according to claim 12, further comprising:

setting by the dryer, a heating time for which is set to be shorter than a heating time for the reference patch by setting the second amount of liquid of the pseudo patch to be smaller than the first amount of liquid of the reference patch.

15. The adjustment method according to claim 12, wherein setting by the dryer, a heating time for which is set to be longer than a heating time for the reference patch by setting the second amount of liquid of the pseudo patch to be larger than the first amount of liquid of the reference patch.

* * * * *